United States Patent [19]

Moritani et al.

[11] 4,209,975

[45] Jul. 1, 1980

[54] TIME ADJUSTING MEANS FOR ELECTRONIC TIMEPIECE

[75] Inventors: Nakanobu Moritani; Toshihide Samejima; Toshio Matsumura; Hajime Oda; Masanori Fujita, all of Tokyo, Japan

[73] Assignee: Kabushiki Kaisha Seikosha, Japan

[21] Appl. No.: 903,476

[22] Filed: May 8, 1978

[30] Foreign Application Priority Data

May 11, 1977 [JP] Japan ..... 52-54124
May 26, 1977 [JP] Japan ..... 52-61349
Apr. 10, 1978 [JP] Japan ..... 53-41943

[51] Int. Cl.[2] ..... G04B 27/00; G04C 3/00

[52] U.S. Cl. ..... 368/186; 368/200; 368/218; 368/85

[58] Field of Search ..... 58/23 R, 33, 34, 63, 58/85.5, 50 R

[56] References Cited

U.S. PATENT DOCUMENTS

| | | | |
|---|---|---|---|
| 3,733,803 | 5/1973 | Hiraga et al. | 58/23 R |
| 3,871,168 | 3/1975 | Maire et al. | 58/23 R |
| 3,928,959 | 12/1975 | Naito | 58/23 R |
| 3,931,703 | 1/1976 | Scherrer et al. | 58/23 R |
| 3,975,896 | 8/1976 | Kasama | 58/23 R |
| 4,030,284 | 6/1977 | Portmann | 58/23 R |
| 4,091,612 | 5/1978 | Meisner et al. | 58/85.5 |
| 4,095,405 | 6/1978 | Tanaka | 58/4 A |
| 4,107,915 | 8/1978 | Sekiya et al. | 58/23 R |
| 4,110,909 | 9/1978 | Fukuichi | 58/575 |

*Primary Examiner*—Vit W. Miska
*Attorney, Agent, or Firm*—Robert E. Burns; Emmanuel J. Lobato; Bruce L. Adams

[57] ABSTRACT

Time adjusting means for electronic timepiece which detects change in the generation condition of pulses generated in response to a manual operation speed and generates a predetermined number of pulses in accordance with the detection output as the time-adjusting pulses. The time adjusting means enables a rapid time adjustment of an electronic timepiece at a high speed. When the manual operation speed exceeds a predetermined speed, the time adjusting means stops the time-adjusting pulse so as to prevent erroneous operation.

7 Claims, 6 Drawing Figures

TIME ADJUSTING MEANS FOR ELECTRONIC TIMEPIECE

BACKGROUND OF THE INVENTION

In conventional electronic timepieces, time correction is mostly made by push button systems of two kinds. In one system the content of a counter is advanced or forwarded by "1" at one push of the push button and in the other system the content is rapidly advanced or fast-forwarded at a predetermined speed so long as the button is being pushed. For correcting the digit of minutes, for example, the push button must be pushed maximum 59 times in accordance with the former and this in indeed troublesome. In the latter system the push button must be pushed for maximum 59 seconds if the time correction periodicity is on the order of one second. If the feed speed is increased so as to avoid this problem, however, it frequently happens that the time to be corrected is rapidly passed over.

SUMMARY OF THE INVENTION

The present invention relates to time adjusting means for an electronic timepiece and specifically relates to time adjusting means which converts pulses generated in response to manual operation further into different pulses so as to make desired time adjustment.

It is a first object of the present invention to provide a novel time adjusting means for an electronic timepiece which converts pulses generated in response to a manual operation speed further into pulses of a predetermined periodicity to use them as time-adjusting pulses for the electronic timepiece.

It is a second object of the present invention to provide a time adjusting means which detects pulses generated in response to a manual operation speed and increases the number of pulses to be generated in the high speed range of manual operation in order to enable the time adjustment at a high speed.

It is a third object of the present invention to provide a time adjusting means which stops generation of time-adjusting pulses in a predetermined high speed range of manual operation so as to prevent erroneous operation.

BRIEF DESCRIPTION OF THE DRAWINGS

The nature of the invention as well as other objects and advantages thereof will become more apparent from consideration of the following detailed description and the accompanying drawings in which.

DESCRIPTION OF THE PREFERRED EMBODIMENTS

Figure 1:
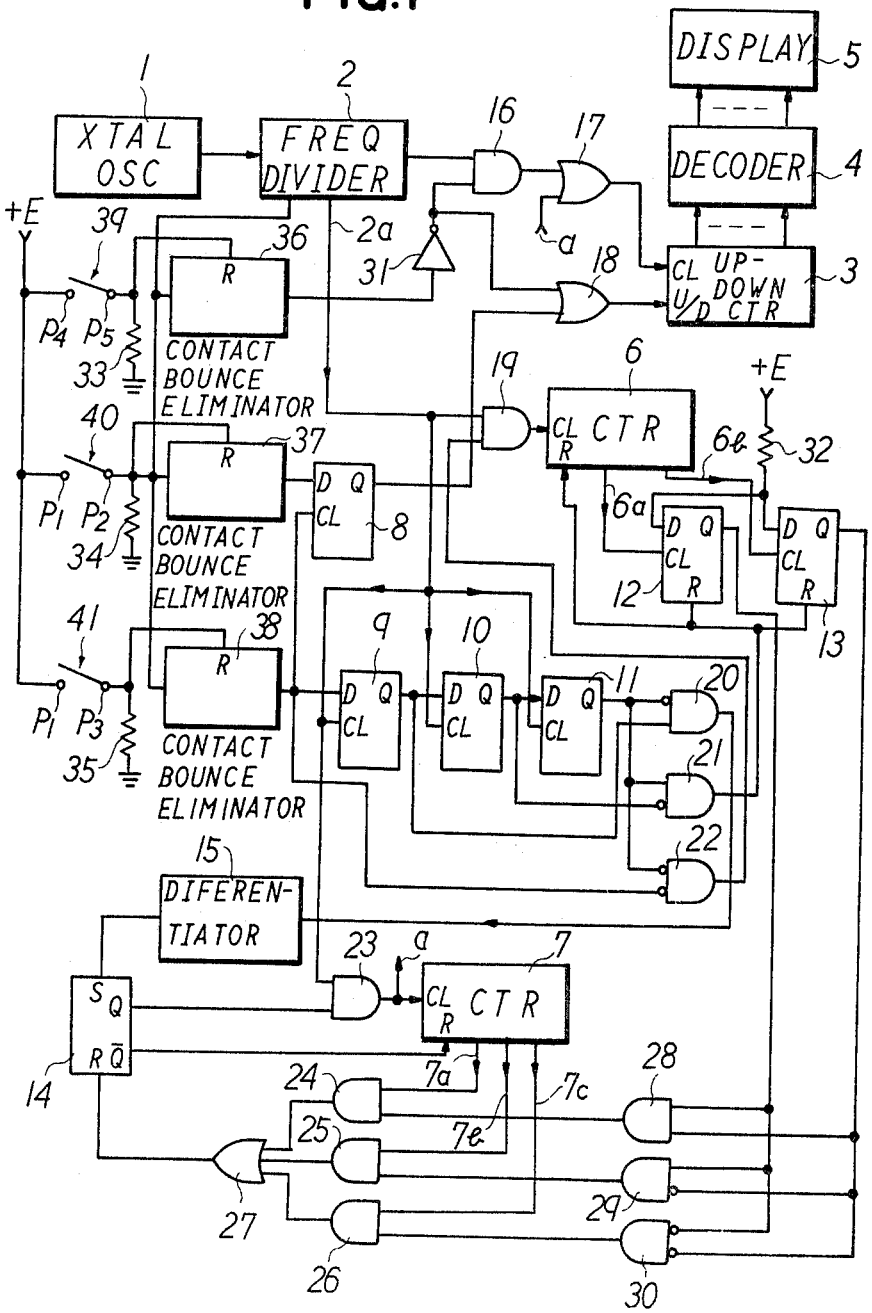
FIG. 1 is an electric circuit diagram of an embodiment of the present invention.

Referring initially to FIG. 1, the output frequency of a crystal oscillator 1 is lowered by a frequency divider 2 down to a frequency which is used as a time-counting pulse and pulses having a frequency higher than the time-counting pulse are generated at a terminal 2*a*. An up-down counter 3 counts the time such as hours and minutes on the basis of the time-counting pulse. The counted output is converted to a signal suitable for display by a decoder-driver 4 and displayed as the time by a display device 5. A counter 6 counts the output pulses from the terminal 2*a* and generates pulses at terminals 6*a* and 6*b* whenever counting is made for a pre-set period. A counter 7 receives the output pulses from the terminal 2*a* and generates pulses at terminals 7*a*, 7*b* and 7*c* whenever counting is made for a pre-set period.

Reference numerals 8 through 14 designate flip-flops; 15 is a differentiator circuit; 16 through 30 are gate circuits; 31 is an inverter; and 32 through 35 are resistors. Contact bounce eliminators 36–38 eliminate electric noise generated at the time of opening and closing of mechanical contacts and are composed of registors and the like. Not only this construction but also logical operation circuits consisting of flip-flops have the same function. Reference symbol E represents a power source. Switches 39–41 are mechanical contacts and have the construction as illustrated in FIG. 2.

Figure 2:
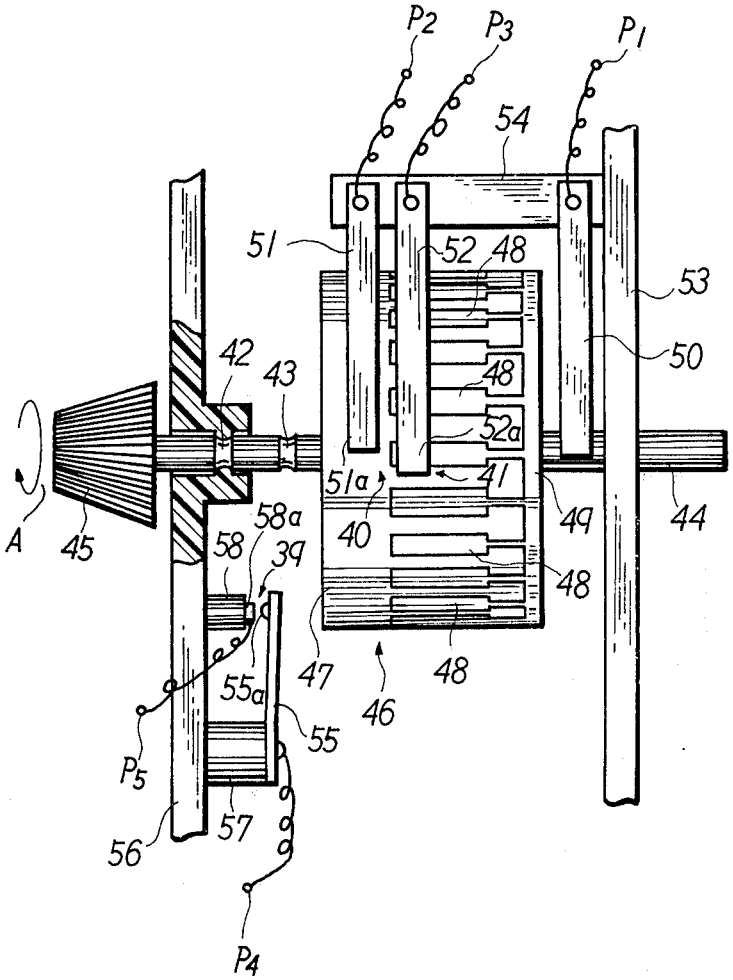
FIG. 2 is a side view showing the detailed construction of the switch used in FIG. 1.

In FIG. 2, a knob 45 is shown secured to one end of an electrically conductive shaft 44 having formed thereon click grooves 42 and 43, and a rotary member 46 of a short cylindrical shape is secured to the center of the shaft 44. Segment electrodes 48—48 are formed on the circumferential surface 47 of this rotary member 46. Each of the segment electrodes has an electrically conductive member 49 formed integrally therewith and is electrically connected to the shaft 44 via the member 49. The shaft 44 is wired to the power source (see FIG. 1) via a contact plate 50 and a terminal $P_1$ that are brought into contact with the shaft.

The tip portions 51*a*, 52*a* of contact plates 51, 52 are respectively deviated or spaced to a considerable extent with respect to the direction of revolution of the rotary member 46. The tip 51*a* and the segment electrode 48 together form the switch 40 and the tip 52*a* and the segment electrode 48 together form the switch 41. The contact plates 51, 52 are respectively grounded via terminals $P_2$, $P_3$ and resistors (see FIG. 1). One end each of the contact plates 50–52 is secured to a pole 54 that is implanted onto a support plate 53. One end of a contact plate 55 is secured to the end portion of a pole 57 implanted onto a support plate 56 and a contact 55*a* is disposed at the other end of the contact plate 55. A contact 58*a* formed at one end of a pole 58 implated onto the support plate 56 is brought into contact with the contact 55*a* of the contact plate 55 which is bent when the shaft 44 moves left-ward as viewed in the drawing. The contact 55*a* and the contact 58*a* together form the switch 39 which is closed and opened when the contact plate 55 is pressed or released by the left end face of the rotary member 46, depending upon the position of the shaft 44. The contact plate 55 is wired to the power source via a terminal $P_4$ and the contact 58*a* is grounded via a terminal $P_5$ and a resistor (see FIG. 1).

Next, explanation will be given of the operation. When the knob 45 of FIG. 2 is pushed in as shown, the switch 39 is opened. When the gate circuit 16 is opened by the output of the inverter 31 shown in FIG. 1, the up-down counter 3 is simultaneously retained at the up-count via the gate circuit 18. For this reason, the output pulse from the frequency divider 2 is applied to the up-down counter 3 through the gate circuits 16 and 17 and hence, counting of the time is effected. The content of the up-down counter 3 is supplied via the decoder 4 to the display device 5, which displays the time.

Figure 3:
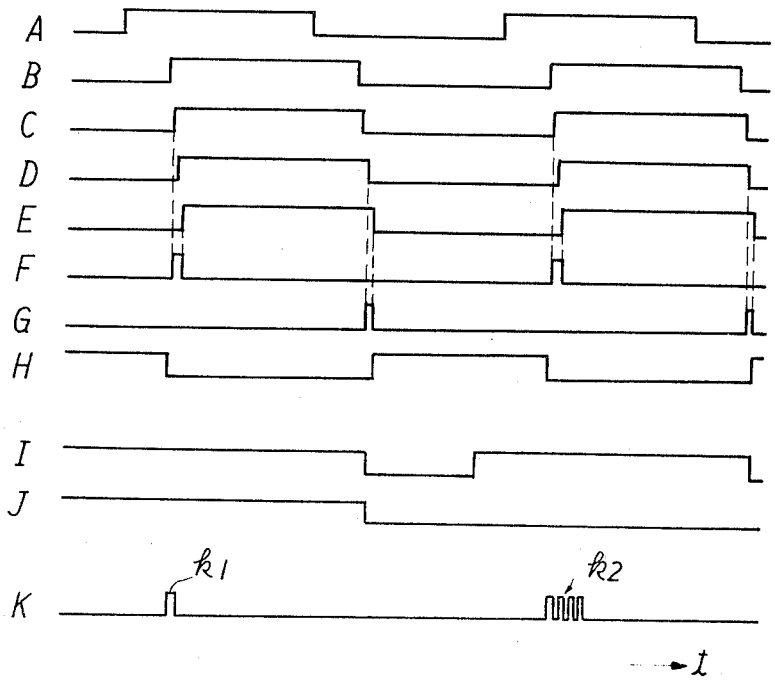
FIG. 3 is a time chart for explaining the operation of the circuit shown in FIG. 1.

Correcting operation of the time is made in the following manner. It will be assumed that the output Q of both flip-flop circuits 12 and 13 shown in FIG. 1 is retained at "1" at the initial stage. When the knob 45 of FIG. 2 is pulled the switch 39 is closed as a result of being pressed by the left end face of the rotary member 46, the tip portions 51*a*, 52*a* of the contact plates 51, 52 are respectively separable from the electrodes 48—48. On the other hand, as the switch 39 is closed as mentioned above, the output level of the inverter 31 is reversed whereby the gate circuit 16 is closed and one input of the gate circuit 18 is retained at "0". In order to advance the content of the up-down counter 3 in this instance, the knob 45 in FIG. 2 is rotated in the direction indicated by the arrow A. This first brings the tip portion 51*a* into contact with the segment electrode 48 and after a little while, brings the tip portion 52*a* into contact with the segment electrode 48. Consequently, pulses having the waveforms A and B shown in FIG. 3 are respectively generated via the contact bounce eliminators 37 and 38 shown in FIG. 1. Hence, the output Q of the flip-flop circuit 8 becomes "1" and the up-down counter 3 is kept at "up" via the gate circuit 18.

The pulses respectively having the abovementioned waveforms A and B are also supplied to the flip-flop circuit 9. To this flip-flop circuit 9 is also supplied a pulse of 512 HZ, for example, from the terminal 2*a* of the frequency divider 2 and this pulse generates a pulse of the waveform C of FIG. 3 at the output Q of the flip-flop circuit 9. Pulses having the waveforms D and of FIG. 3 and E are respectively generated at the output Q of the flip-flop circuits 10 and 11. These pulses together generate a pulse of the waveform F from the gate circuit 20 and its differentiated output sets the flip-flop circuit 14. Accordingly, the gate circuit 23 is opened by the output Q of the flip-flop circuit 14, and the pulse from the frequency divider 2 generates a pulse $K_1$ of the waveform K shown in FIG. 3 which is in turn applied to the counter 7 as well as to the up-down counter 3 via the gate circuit 17 whereby the content of the counter is advanced by "1". The counter 7 is so designed that when it counts "1", a pulse is generated from its terminal 7*a*.

On the other hand, the output of the gate circuit 28 is retained at "1" since the output Q of the flip-flop circuits 12, 13 is retained at "1" at the initial stage as described previously. For this reason, the abovementioned pulse at the terminal 7*a* of the counter 7 re-sets the flip-flop circuit 14 via the gate circuits 24, 27, closes the gate circuit 23 and re-sets the counter 7.

As mentioned above, immediately after revolution of the knob 45, one time-adjusting pulse is generated and advances the content of the up-down counter by "1".

Meanwhile a pulse having the waveform G shown in FIG. 3 is generated from the gate circuit 21 at the time near the stop points of the pulses of the waveforms D and E shown in FIG. 3 generated respectively at the output of the flip-flop circuits 10 and 11. This pulse re-sets the counter 6 as well as the flip-flop circuits 12 and 13. On the other hand, when the abovementioned pulse at the output Q of the flip-flop circuit 11 stops, the output of the gate circuit 22 reverses to "1" as indicated by the waveform H shown in FIG. 3 and the gate circuit 19 is thereby opened. Accordingly, the pulse from the frequency divider 2 is applied to the counter 6 via the gate circuit 19. In this manner, counting occurs during the period from the stop of the abovementioned pulse from the output Q of the flip-flop circuit 11 until subsequent generation of the pulse from the same output Q, that is, during the period from cut-off of the contact between the tip portion 51*a* and one segment electrode 48 and the subsequent contact of the tip portion 51*a* with the other segment electrode 48 shown in FIG. 2. In other words, the speed of revolution of the knob 45 in FIG. 2 is thus detected.

In the embodiment hereby described, the counter 6 is set so that when it counts for about 0.25 to 0.5 seconds, pulses are respectively generated from the terminals 6*a* and 6*b*. For example, when the contact between the tip portion 51*a* and the segment electrode 48 is cut off and established once after the output of the waveform I in FIG. 3 is generated from the terminal 6*a* of the counter 6 and before the output pulse of the waveform J of FIG. 3 is generated from the terminal 6*b*, that is, during the period of from 0.25 to 0.5 seconds, a pulse of the waveform F in FIG. 3 is generated from the gate circuit 20 by the output of the gate circuit 29 while the gate circuit 25 is kept open. The resulting pulse sets the flip-flop circuit 14 and its output Q opens the gate circuit 23 whereby the output pulse from the frequency divider 2 is applied to the up-down counter 3 and the counter 7.

The counter 7 is set in such a manner that when it counts "4", a pulse is generated from its terminal 7*b*. Accordingly, when "4" pulses are applied to the counter 7 via the gate circuit 23, the pulse is generated from the terminal 7*b* of the counter 7 and resets the flip-flop circuit 14 via the gate circuits 25 and 27. Thus, the content of the up-down counter 3 is advanced by "4". If the knob 45 is rotated in this manner at such a speed that the contact between the tip portion 51*a* and the segment electrode 48 is once cut off and established during the period of from 0.25 to 0.5 seconds, the content of the up-down counter 3 is advanced by "4" due to one contact and cut-off of these members 51*a* and 48.

If the speed of revolution of the knob 45 is slower so that one contact and cut-off between the tip portion 51*a*; and the segment electrode 48 takes more than 0.5 seconds, a pulse is generated from the gate circuit 20 while the output Q of both flip-flop circuits 12 and 13 is at "1" and one time-adjusting pulse is applied to the up-down counter 3 in the same way as mentioned above. In other words, when the speed of revolution of the knob 45 is retarded, the number of occurrence of the time-adjusting pulses is decreased and along therewith, the advancing speed of the up-down counter 3 also is retarded.

On the contrary, if the speed of revolution of the knob 45 is increased so that one cut-off and contact between the tip portion 51*a* and the segment electrode 48 are made within 0.25 seconds, a pulse is generated from the gate circuit 20 before a pulse is generated at the terminal 6*a* of the counter 6, that is to say, while the output Q of both flip-flop circuits 12 and 13 is "0". Hence, the counter 7 counts the output pulses from the frequency divider 2 and is so set that when it counts eight pulses, it produces a pulse from its terminal 7*c*. In this case, therefore, the up-down counter 3 is caused to advance by "8".

In order to decrease the content of the up-down counter 3, the knob 45 shown in FIG. 2 may be rotated in the direction opposite the direction depicted by the arrow A. Contrary to the aforementioned operation, the operation in this case is as follows. The tip portion 52*a* first contacts the segment electrode 48 and the tip portion 51*a* rather belatedly contacts the segment electrode 48. The output Q of the flip-flop circuit 8 is reversed to "0" due to the pulses from the contact bounce eliminators 40 and 41. Accordingly, the up-down counter 3 is changed over to the "down" mode. The subsequent operations are exactly the same as those described above.

Figure 4:
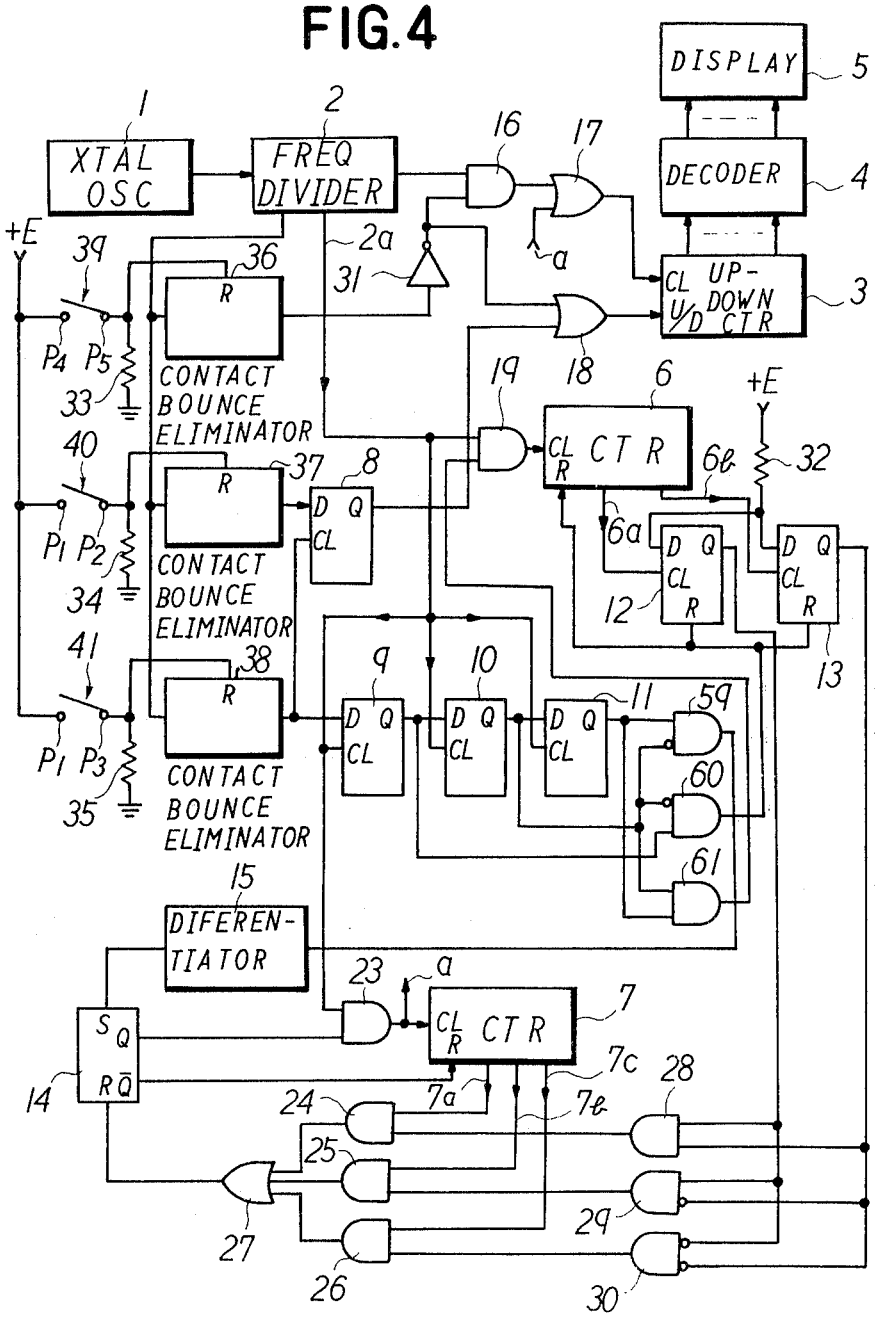
FIG. 4 is an electric circuit diagram of another embodiment of the present invention.

In the embodiment described above, the speed of revolution of the knob 45 is detected by means of the time from the cut-off of contact of the tip portion 51*a* and the segment electrode 48 to the contact of the tip portion 51*a* with the segment electrode 48. However, the speed of revolution may also be detected by means of the contact time between the tip portion 51*a* and the segment electrode 48. FIG. 4 illustrates an example of a circuit having this mode of operation. In this drawing, reference numerals 59 through 61 designate gate circuits, and like reference numerals are employed to designate like members as in FIG. 1.

Figure 5:
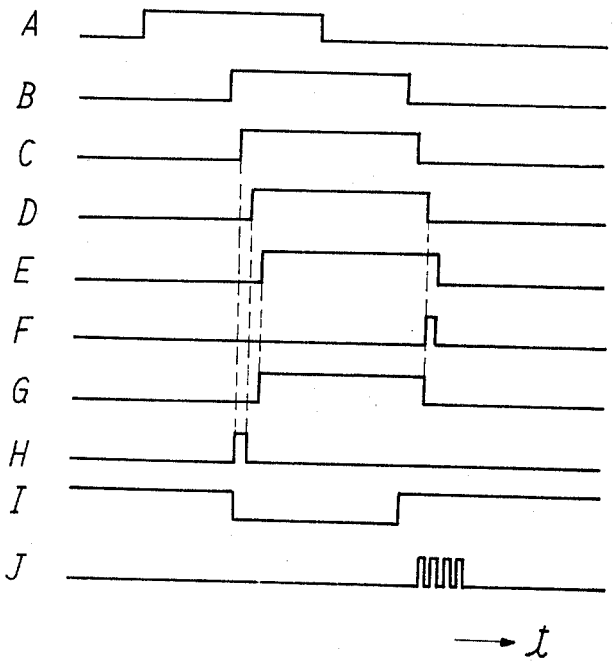
FIG. 5 is a time chart for explaining the operation of the circuit shown in FIG. 4.

Explanation will be given of the mode of operation. When the knob 45 shown in FIG. 2 is rotated in the direction indicated by the arrow A, pulses having the waveforms A and B shown in FIG. 5 are generated respectively from the contact bounce eliminators 37 and 38 and pulses having the waveforms C, D and E of FIG. 5 are generated respectively from the flip-flop circuits 9–11 due to the pulse from the contact bounce eliminator 38. Due to these pulses, pulses having the waveforms F, G and H are generated respectively from the gate circuits 59 and 60. The pulse of the waveform H of FIG. 5 generated at the output of the gate circuit 60 re-sets the counter 6 and the flip-flop circuits 12 and 13, and the pulse of the waveform G of FIG. 5 generated at the output of the gate circuit 61 opens the gate circuit 19.

For the reasons mentioned above, the counter 6 counts the pulses from the frequency divider 2, that is, the time corresponding to the contact time between the tip portion 51*a* and the segment electrode 48 shown in FIG. 2. When a pulse of the waveform F of FIG. 5 is generated from the gate circuit 59 after the output Q of the flip-flop circuit 12 is reversed to "1" as the waveform I of FIG. 5 by the pulse from the terminal 6*a* of the counter 6 and before the pulse is generated from the terminal 6*b* of the counter 6, for example, four time-adjusting pulses of the waveform J of FIG. 5 are generated from the gate circuit 23, thereby advancing the up-down counter 3 by "4".

As already described, if the speed of revolution of the knob 45 is retarded, one contact between the tip portion 51*a* and the segment electrode 48 produces one time-adjusting pulse and advances the content of the up-down counter 3 by "1" in the same way as in the aforementioned embodiment.

If the speed of revolution of the knob 45 is so increased that the contact is cut off between the tip portion 51*a* and the segment electrode 48 before a pulse is generated from the counter 6, one contact between the tip portion 51*a* and the segment electrode 48 produces eight time-adjusting pulses and advances the content of the up-down counter 3 by "8" in the same way as in the aforementioned embodiment.

As mentioned above, the number of the time-adjusting pulses to be supplied to the up-down counter 3 is stepwise changed in accordance with the speed of revolution of the knob 45. When the time-adjusting range of the up-down counter 3 is wide, therefore, the knob 45 is rapidly rotated at first and then slowly turned near the desired time in order to make accurate time adjustment.

In the embodiments described above, the speed of revolution of the knob 45 is detected at three separate stages so as to vary stepwise the pulses generated in response to the manual operation of the switch to one pulse, four pulses and eight pulses. However, the number of stages may be properly increased or decreased by properly increasing or decreasing the flip-flop circuits 12, 13 and the gate circuits 24–26 and 28–30 in order to properly select the counter output of the counter 7 and thus set the number of time-adjusting pulses at each stage to an optional number. It is also possible to set optionally the number of time-adjusting pulses in response to the manual operation of the switch by properly setting the frequency of the pulse to be supplied from the frequency divider 2 to the counters 6 and 7 and selecting a proper counting capacity of the counter 6.

Next, an explanation will be given with reference to FIG. 6 of the embodiment wherein the knob 45 is rotated at a high speed and an output "1" is generated from the differentiator circuit 15 before the terminal of the counter 6 reverses to "1".

Figure 6:
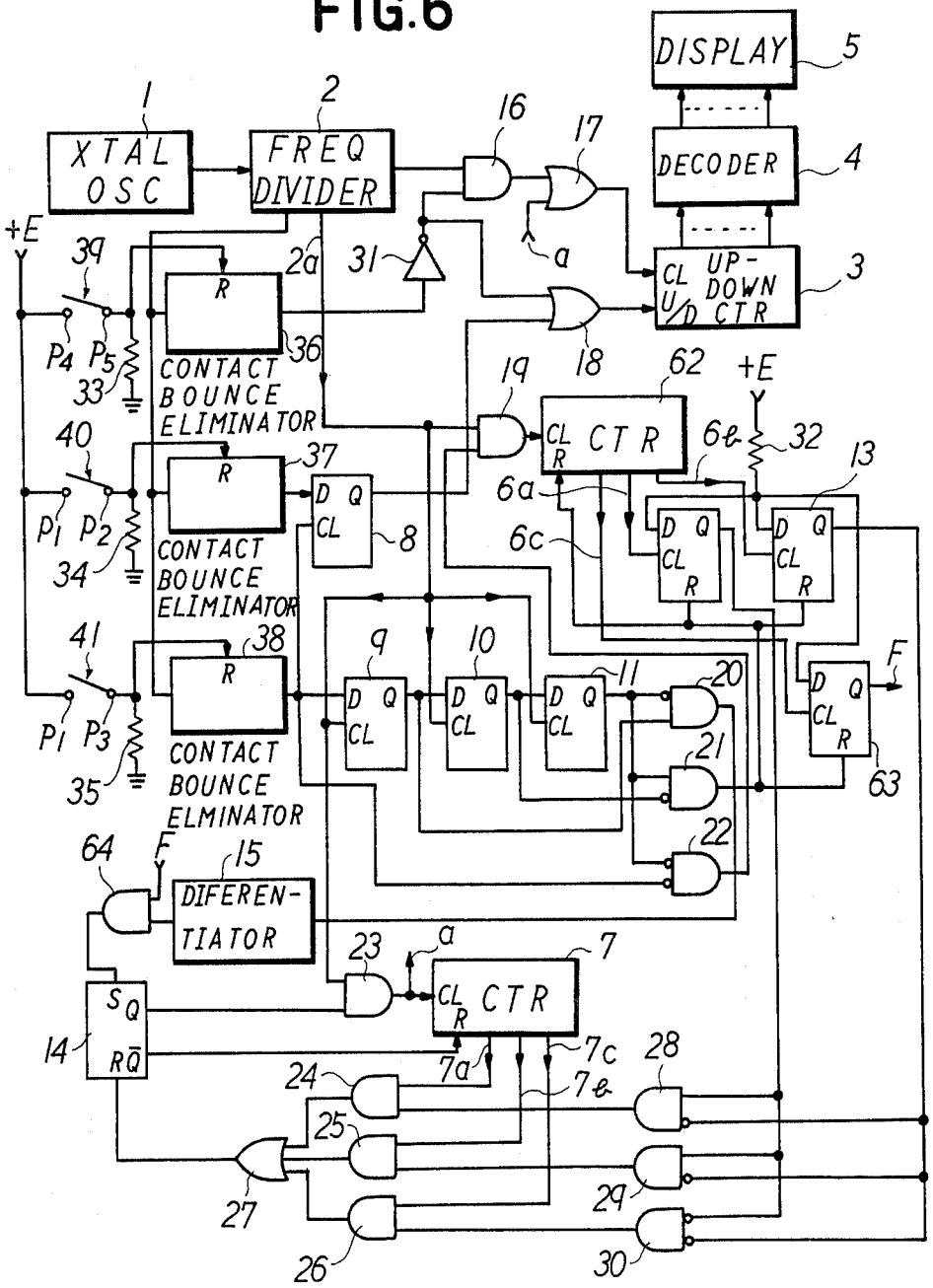
FIG. 6 is an electric circuit diagram of still another embodiment of the present invention.

The counter 62 shown in FIG. 6 has substantially the same function as the counter 6 shown in FIGS. 1 and 4 with the exception that a terminal 6*c* is provided at a stage prior to the stage of the terminal 6*a*. Reference numeral 63 designates a flip-flop circuit and 64 designates a gate circuit. Like reference numerals are used to identify those members which are in common with FIGS. 1 and 4.

In the above-mentioned construction, when the output "1" is generated from the gate circuit 20, the output Q of the flip-flop circuit 63 is "0". Accordingly, the gate circuit 64 is kept closed whereby the abovementioned output is prevented and the reset condition of the flip-flop circuit 14 does not change. Consequently, no pulse is applied to the up-down counter 3 and its time-adjustment is not performed.

The time-adjusting pulse is stopped as mentioned above under the high speed condition for the following reason. At such a high speed, the phases of two pulse trains generated by the opening and closing of the switches 40 and 41 approach each other whereby the phase of the pulse trains generated from the contact bounce eliminators 37 and 38 tend to cause reversal of the counting direction due to influence of the contact bounce, etc. In other words, even when the time adjustment is made while the up-down counter 3 is set to "up", the counter 3 tends to be changed over to "down" during its operation. In order to prevent this problem, the time-adjusting pulse is removed when the knob 45 is rotated at a high speed.

However, the circuits shown in FIGS. 1 and 4 may be satisfactorily used in such cases where possibility of the abovementioned erroneous operation is not a critical problem or where there is no possibility of such an erroenous operation.

The foregoing embodiments use the up-down counter 3. However, the present invention can be adapted also to such an embodiment which uses only an up-counter as the counter. In such a case, since no change-over of the up-down counting mode is necessary, the pulse generated from the manual revolution switch may be of a single system.

In the foregoing embodiments, further, the pulse is generated by the contact and cut-off of the contact between the segment electrode formed on the rotary member and the tip portion of the contact plate. However, the pulse may also be generated by repeated operation of an automatic-return type push switch. It is necessary in such a case to use an up-counter as a counter as the object of time-adjustment, or to make switching between up and down counting mode by a separate manual switch if an up-down counter is used. If the circuit construction of FIG. 1 is used, the number of time-adjusting pulses varies in accordance with the push interval of the push switch and when the circuit construction of FIG. 4 is used, the number of correction pulse varies in accordance with the push period of the push switch.

As described in detail in the foregoing paragraphs, the present invention generates a predetermined number of time-adjusting pulses in response to the pulse generated in accordance with the operation speed of the manual switch. Accordingly, it is possible to make time-adjustment advancing or retarding a timepiece setting in accordance with the manual operation speed. For making the time adjustment from the digit of minutes to that of hours, for example, the adjustment up to the digit of hours can be made within an extremely short period by supplying a time-adjusting pulse to the first order digit of minutes. Moreover, for the time-adjustment of the first order digit of minutes, the adjustment can be made slowly and accurately without passing over a desired time, thereby eliminating the provision of the conventional digit-selection switch or change-over switch for the time-adjusting speed. In addition, since it is possible in accordance with the present invention to optionally set the relation between the manual operation speed of the switch and the number of the time-adjusting pulses, a mechanical switch having a simple construction can be used. Accordingly, if an automatic-return type push switch is used as the mechanical switch and logical operation circuits such as counters in combination with gate circuits are used as generation means for time-adjusting pulses, therefore, it is possible to set extremely easily the relation between the manual operation speed and the correction speed by properly selecting the logical operation circuit and to make the construction extremely compact. Hence, the present invention is effective to reduce the size of a timepiece.

If a small rotary member having a plurality of segment electrodes and contact plates capable of contacting and disconnecting these segment electrodes are used as the mechanical switch, the time-adjustment can be made with an extremely easy turning operation.

Furthermore, if the time-adjusting pulse is stopped by changing the number of pulses within a predetermined range of the manual operation speed when the operation speed exceeds this range, the device to be supplied with the time-adjusting pulses are always furnished with constant pulses. Accordingly, the present invention exhibits remarkable advantages as the time-adjusting means for an electronic timepiece.

What is claimed is:

1. A time adjusting circuit for an electronic timepiece, comprising:

first pulse generation means for generating electrical pulses at a manually selectable frequency;

detection means responsive to the electrical pulses from said first pulse generation means for detecting variation of the frequency of the electrical pulses and for developing an output signal having values to indicate when the frequency of the electrical pulses is within predetermined ranges;

second pulse generation means responsive to the output signal from said detection means for generating a different predetermined number of output electrical pulse according to the value range within which the detection means output signal lies; and means for applying the output electrical pulses from said second pulse generation means as a time correction signal.

2. A time adjusting circuit for an electronic timepiece according to claim 1, wherein said first pulse generation means includes a manually moveable member and is effective for generating electrical pulses at a frequency corresponding to a speed of said manually moveable member.

3. A time adjusting circuit for an electronic timepiece according to claim 2, wherein said manually moveable member is rotatable and said first pulse generation means is effective for generating electrical pulses at a frequency corresponding to a speed of rotation of said rotatable member.

4. A time adjusting circuit according to claim 3, further comprising means responsive to the detection means output signal for preventing generation of the electrical output pulses from said second pulse generation means when the rotation speed of said manually rotatable member represented by the value of the detection means output signal exceeds a predetermined speed.

5. In an electronic timepiece according to claim 3, said first pulse generation means comprising:

said manually rotatable member;

switching means cooperative with said manually rotatable member for successively opening and closing at a rate determined by the speed of rotation of said manually rotatable member; and a pulse generating circuit connected to said switching means for generating an electrical pulse signal in response to opening and closing of said switching means.

6. A time adjusting circuit for an electronic timepiece according to claim 1, wherein said detection means comprises means responsive to pulses from said first pulse generation means for developing an output signal everytime a predetermined interval of time elapses, and wherein said second pulse generation means comprises means for developing a selected predetermined number of pulses in response to the output signal from said means comprising said detection means.

7. A time adjusting mechanism for an electronic timepiece, comprising:

a manually rotatable member having a shaft mounted for rotation;

switching means cooperative with said manually rotatable member for successively opening and closing at a rate determined by the speed of rotation of said manually rotatable member;

pulse generating means for generating an electrical pulse signal in response to opening and closing of said switching means;

first means comprising a counter responsive to pulses from said pulse generating means for developing an output signal everytime a predetermined interval of time is counted;

second means for developing a selected predetermined number of pulses in response to the output signal from said first means; and means for applying the output pulses from said second means as time correction pulses.

* * * * *